US006119862A

United States Patent [19]

Childress

[11] Patent Number: 6,119,862

[45] Date of Patent: Sep. 19, 2000

[54] PACKAGE FOR A FOOD PRODUCT WITH DISPLAY TABS

[75] Inventor: Jeffrey K. Childress, Bartlett, Tenn.

[73] Assignee: Sara Lee Corporation, Winston-Salem, N.C.

[21] Appl. No.: 08/824,037

[22] Filed: Mar. 26, 1997

[51] Int. Cl.[7] ..... B65D 1/34; B65D 25/24

[52] U.S. Cl. ..... 206/557; 206/561; 220/633; 229/903; 426/110; 426/119

[58] Field of Search ..... 206/557, 558, 206/561, 562; 229/903, 904, 905, 123.1; 426/110, 119, 120; 220/628, 631, 633, 638

[56] References Cited

U.S. PATENT DOCUMENTS

| | | | |
|---|---|---|---|
| 2,657,998 | 11/1953 | Peters | 426/119 |
| 2,924,372 | 2/1960 | Kirkeby | 229/904 X |
| 3,394,869 | 7/1968 | Fontana et al. | 426/120 X |
| 3,495,759 | 2/1970 | Bergstrom et al. | 229/123.1 X |
| 3,610,458 | 10/1971 | Nissley | 426/120 X |
| 3,983,999 | 10/1976 | Morton | 426/119 X |
| 4,427,148 | 1/1984 | Seiter et al. | 229/123.1 |
| 4,579,276 | 4/1986 | Manizza | 426/113 X |
| 5,042,652 | 8/1991 | Grindrod | 206/557 X |
| 5,123,527 | 6/1992 | Hustad | 426/119 X |
| 5,348,218 | 9/1994 | Haire et al. | 229/904 X |
| 5,375,701 | 12/1994 | Hustad et al. | 220/631 X |
| 5,564,569 | 10/1996 | Kiefer | 220/633 X |

*Primary Examiner*—Bryon P. Gehman
*Attorney, Agent, or Firm*—Charles Y. Lackey; Kilpatrick Stockton LLP

[57] ABSTRACT

A package for a food product which includes a rigid tray formed from a single piece of malleable material having flanges located in a reference plane, first and second side walls, first and second end walls and a bottom all integrally joined. Integrally formed tabs are defined at the junction of the side walls and the bottom which extend generally in the plane of the side walls a predetermined distance. Some of the tabs with the peripheral flange form an upright display support permitting the package to be displayed upright with the front panel located in a vertical or near vertical plane facing forward. A hanging feature can also be incorporated into the rigid tray flange to provide peg-board display if desired. This can be accomplished with no added labor or material cost. A thin flexible film covers the tray in the reference plane and attaches to the peripheral flanges to hermetically seal the recessed compartment. The recessed compartment or compartments may or may not be vacuumized or have modified atmospheres.

10 Claims, 3 Drawing Sheets

PACKAGE FOR A FOOD PRODUCT WITH DISPLAY TABS

FIELD OF THE INVENTION

The present invention relates to packages, and particularly to a package for a food product or the like or any product that has need to be displayed on retail shelves without the use of cartons.

BACKGROUND OF THE INVENTION

Various packages are used for packaging, preserving and displaying food and the like which retain the food product in a form that is visible to a potential consumer. One such package includes a tray having individual components formed therein for receiving food products and a thin flexible film covering the tray and adhered thereto for sealing off the individual compartments.

In many instances, sealed trays of the type described above are thereafter positioned within a sleeve for protection and attractive decoration. Other second containers include a closed box with window openings for viewing the food products contained in the tray through the flexible film and windows.

While the packaging described above satisfactorily protects the food products and allows the consumer a complete inspection prior to purchase, there are certain disadvantages associated therewith. Such packaging is relatively expensive and, in many instances, does not provide enough consumer appeal because a visual inspection of the food product is, at least to some degree, limited.

In other situations, it is desirable to display the packaged food product in a variety of ways and not just the traditional way of placing it flat in the food box so that it can be viewed downwardly by the consumer through the top. Because of shelf space requirements and other commercial needs, it is often desirable to hang the food package on a pegboard or position it on an edge so that it stands in an upright manner, thus providing room for more units in a given amount of shelf or counter space. In order to enable the package to stand in such a manner, an additional construction feature is sometimes included with a slide or tray such as a flap or closing edge like that shown in U.S. Pat. No. 5,042,652. Yet another such device includes a tab as is shown in U.S. Pat. No. 5,123,527 which is preformed in a portion of the sleeve or box and folds outwardly to cooperate with the peripheral flange and maintain the package on its edge in an upright condition.

While these features are also effective and accomplish satisfactory results, they increase the cost of the packaging by added labor and material.

Thus, there exists a need to provide a food package which uses less material, incurs less labor costs, enables the package to assume positions in a flat condition and on an edge, and permits the viewing of the food products within the compartments of the tray. It is to this need that the present invention is directed.

SUMMARY OF THE INVENTION

The present invention for a food product package includes a tray formed from a single piece of malleable or moldable material having generally flat peripheral flanges located in a reference plane defining the periphery of the tray. The tray has side walls, end walls and a bottom with the bottom integrally joining the end walls and side walls. Integrally formed tabs are defined at the junction of the side walls and the bottom which extend generally in the plane of the side walls a predetermined distance. Some of the tabs with a portion of the peripheral flange form an upright display means permitting the package to be displayed upright with the front panel located in a vertical plane facing forward. A thin flexible film covers the tray in the reference plane and attaches to the peripheral flanges to air tightly seal the interior of the tray.

Thus, the primary purpose of the present invention is to provide a food package of the type described which includes an integrally formed tray with integrally formed tabs that allow the package to be displayed in an upright position.

Another objective of the present invention is to provide a food product package of the type described which permits the package to be displayed in a flat and a vertical position on the grocer's shelf.

Yet another objective of the present invention is to provide a low cost food package utilizing, in some instances, only two integral material sections to form the entire package.

Yet another objective of the present invention is to provide a two piece food package which can be decorated directly on the sealing top of the package by utilizing pre-printed film or adhering appropriate labels and the like thereto.

Another objective of the present invention is to eliminate subsequent packaging operations by packaging multiple components in the tray (regardless of the number of compartments) prior to the sealing of the finished product. This would be a one-step complete packaging operation if desired.

Yet still another further objective of the present invention is to provide a food package of the type described wherein the tray can be integrally formed with multiple compartments for providing separate kinds of food products therein (with different atmosphere requirements if needed) which will be air tightly sealed by the thin flexible film covering the tray.

Thus, there has been outlined, rather broadly, the more important features of the invention in order that the detailed description that follows may be better understood and in order that the present contribution to the art may be better appreciated. There are obviously additional features of the invention that will be described hereinafter and which will form the subject matter of the claims appended hereto. In this respect, before explaining several embodiments of the invention in detail, it is to be understood that the invention is not limited in its application to the details in construction and to the arrangement of the components set forth in the following description or illustrated in the drawings. The invention is capable of other embodiments now being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designating other structures, methods and systems for carrying out the several purposes of this development. It is important that the claims be regarded as including such equivalent constructions insofar as they do not depart from the spirit and scope of the present invention.

So that the manner in which the above recited features, advantages and objects of the invention, as well as others which will become apparent, are obtained and can be understood in detail, a more particular description of the invention briefly summarized above may be had by reference to the embodiments thereof which are illustrated in the appended drawings, which drawings form a part of the specification and wherein like characters of reference designate like parts throughout the several views. It is to be noted, however, that the appended drawings illustrate only preferred and alternative embodiments of the invention and are, therefore, not to be considered limiting of its scope, as the invention may admit to additional equally effective embodiments.

DETAILED DESCRIPTION OF THE DISCLOSURE

Figure 1:
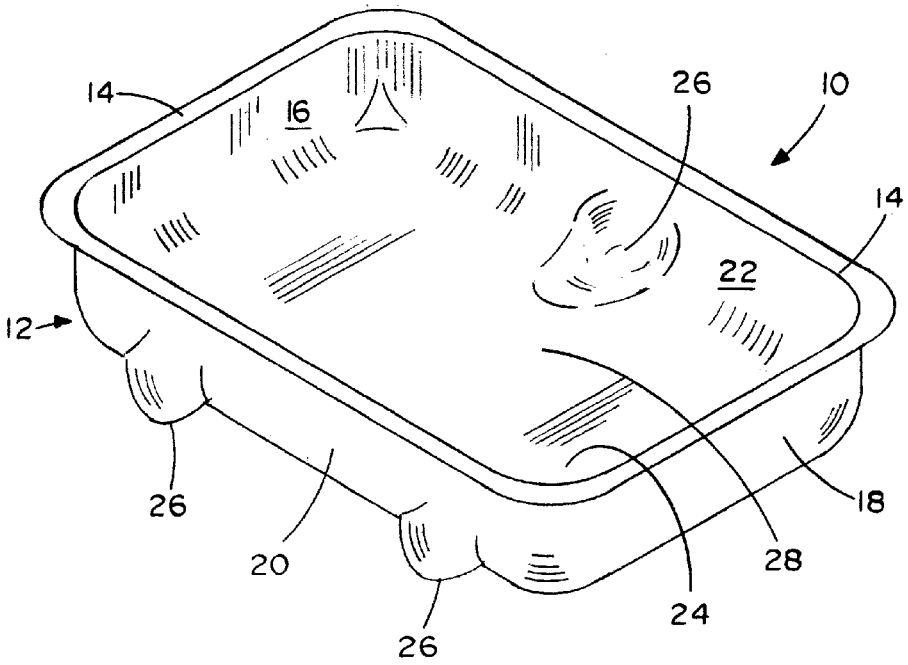
FIG. 1 is a perspective view of a food package of the present invention wherein a single compartment integrally formed tray is covered by a clear thin flexible film.
Figure 2:
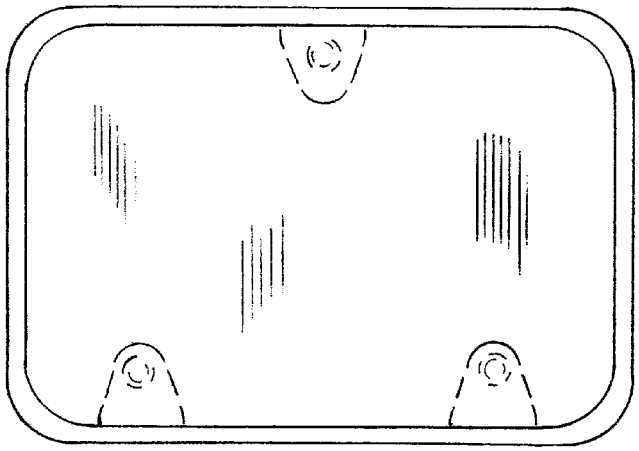
FIG. 2 is a top plan view of the tray shown in FIG. 1.
Figure 4:
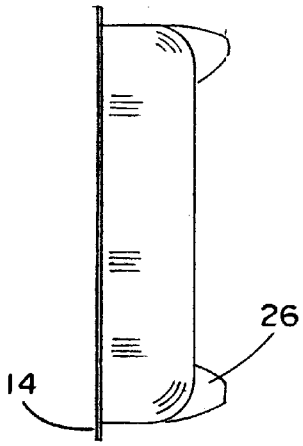
FIG. 4 is an end elevational view of the tray shown in FIGS. 1, 2 and 3.
Figure 3:
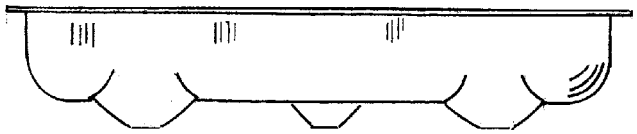
FIG. 3 is a side elevational view of the tray shown in FIGS. 1 and 2.

Referring now to the drawings and particularly to FIG. 1, a food package shown generally as 10 includes a tray 12 formed from a single piece of malleable or moldable material having generally flat peripheral flanges 14 located in a reference plane defining the periphery of tray 12. Tray 12 includes first and second end walls 16, 18, first and second side walls 20, 22 and a bottom 24. Bottom 24 integrally joins end wall 16, 18 and side walls 20, 22 as shown. A plurality of tabs 26 are integrally formed at the junction of side walls 20, 22 and bottom 24 and are shaped to extend generally downwardly from the bottom approximately in the plane of the side walls for a predetermined distance. At least two of tabs 26 positioned within the same side wall 20 can cooperate with a peripheral side flange 14 to permit the package to be displayed upright with the front panel located in a vertical plane facing forward. One or more additional tabs 26 (FIG. 1) in conjunction with side wall 22 can be used to support the food package in a level position when it is displayed flat on the shelf in a traditional manner. Without such a tab, side 22 of the package would be lower than side 20 and thus provide an unattractively displayed package.

Tray 12 of the present invention has been designed so that it can be molded from a single piece of malleable material, thus eliminating all joined edges and separate components. The result is an extremely inexpensive package, particularly when the tray 12 holds a single food product and is covered by a thin flexible film 28 that is attached to flanges 14 to air tightly seal the tray interior.

Figure 5:
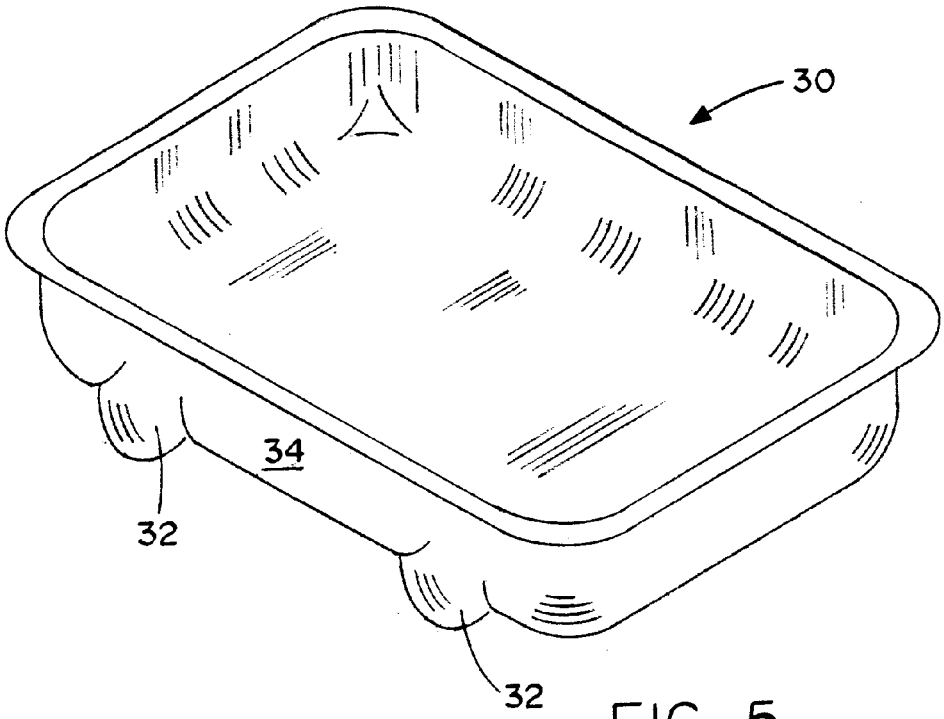
FIG. 5 is a perspective view of another embodiment of a food package having an integrally formed tray which is closed by a thin flexible film.
Figure 6:
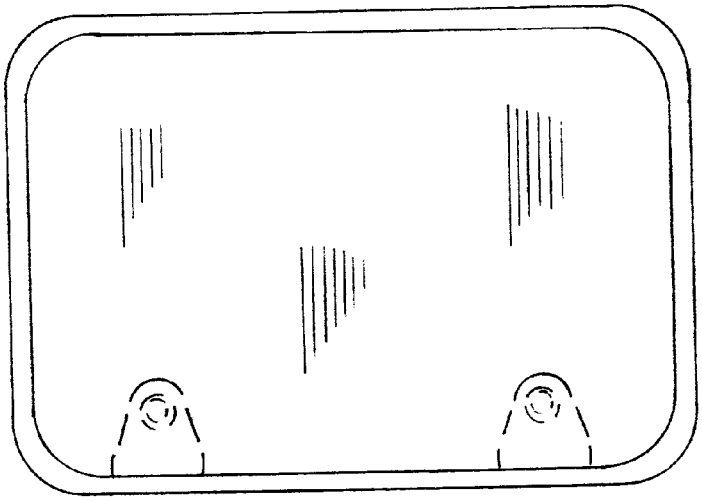
FIG. 6 is a top plan view of the tray shown in FIG. 5.
Figure 8:
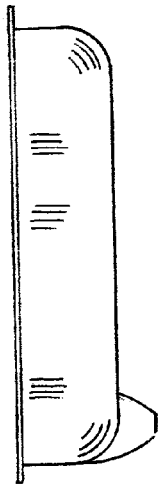
FIG. 8 is an end elevational view of the tray shown in FIGS. 5, 6 and 7.
Figure 7:
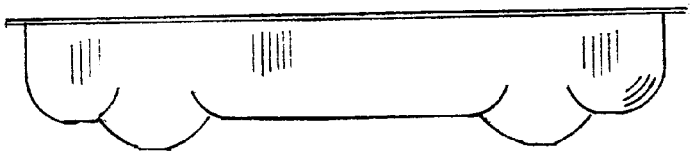
FIG. 7 is a side elevational view of the tray shown in FIGS. 5 and 6.

Another smaller embodiment of the food package comprising the present invention is shown in FIG. 5 wherein the integrally formed tray 30 has only two tabs 32 in one side 34, it being primarily designed to be displayed vertically as shown in FIG. 8. A tray of this nature is ideal for packaging sausages and lends itself readily to receive a decorated and informative label securely positioned to the thin flexible film sealing the compartment.

Figure 9:
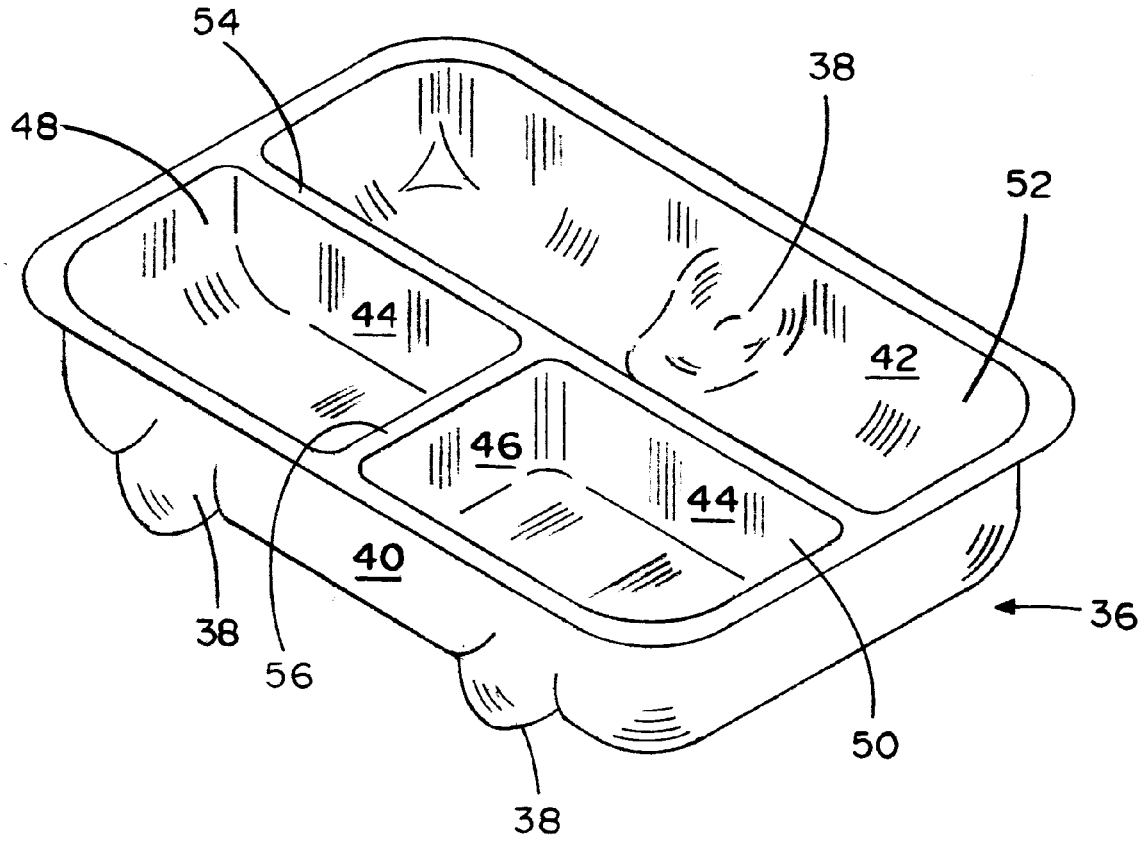
FIG. 9 is a perspective view of another embodiment of a food package comprising the present invention wherein the tray has integrally formed dividers within its interior so that various food products can be separately retained therein.

Yet another embodiment of a tray forming a part of the present invention is shown generally as 36 in FIG. 9. This tray has multiple tabs 38 in side walls 40, 42 and also has integrally formed dividers 44, 46 that serve to form plural compartments 48, 50, 52 to carry multiple food products. The thin flexible film covering the tray adheres to the flanges as well as the upper edges 54, 56 of dividers 44, 46 so that an air tight seal is formed in each compartment. Such an arrangement also prevents the flavor of one food product from migrating into an adjacent compartment and commingling with the flavor of another food product.

The formed food package comprising the present invention can be made on any of several commercially available machines with the proper tooling and dyes for the desired design. Suitable material which can be used to produce the package include, for the top non-formed, flexible film, 50 gauge saran coated Polyethylene Terephthalate/0.002 inch PE/Surlyn coex sealant film or non-printed 2 mil Surlyn, 0.5 mil saran coated polyester. Barrier material may be added to either of these films, if necessary, to improve freshness and preserving quality.

The bottom formed, semi-rigid film can be 25 mil Polypropylene Styrene/Ethyl vinyl alcohol coex, black (if microwaveability is desirable) or 25 mil PVC/Surlyn (non-barrier).

In all of the embodiments shown, labels can be applied to the thin flexible film having clear portions or windows positioned therein so that the food products can be viewed at various locations in the label and yet the package carry attractive decoration and useful information thereon. It is to be understood that any of the embodiments of the present invention shown herein can be further positioned in a box or sleeve if that be desirable to give further protection to the package during handling.

While the invention has been described in detail with respect to several embodiments, it will be obvious that numerous modifications and variations will be apparent to those skilled in the art without departing from the spirit and scope of the invention.

What is claimed is:

1. A package with at least one compartment for a food product having a bottom, side walls, end walls, and a front panel, the package comprising: a tray formed from a single piece of malleable material having generally flat peripheral flanges located in a reference plane defining the periphery of the tray, the tray having first and second side walls, first and second end walls and a bottom, the bottom integrally joining the end walls and side walls; integrally formed tabs defined at the junction of the side walls and the bottom, the tabs extending generally in the plane of the side walls a predetermined distance and some of the tabs with a peripheral flange forming an upright display means permitting the package to be displayed upright with the front panel located in a vertical plane facing forward; and a thin flexible film covering the tray in the reference plane and attached to the peripheral flanges to air-tightly seal at least one compartment.

2. The package of claim 1 wherein at least one tab is formed in the junction of the first side wall and the bottom.

3. The package as claimed in claim 2 wherein at least two tabs are formed in the junction of the second side and the bottom.

4. The package as claimed in claim 3 wherein the flexible film is transparent.

5. The package as claimed in claim 2 wherein the flexible film is transparent.

6. The package as claimed in claim 1 wherein at least two tabs are formed in the junction of the second side and the bottom.

7. The package as claimed in claim 6 wherein the flexible film is transparent.

8. The package as claimed in claim 1 wherein the flexible film is transparent.

9. A package at least one compartment for a food product having a bottom, side walls, end walls and a front panel, the package comprising: a tray formed from a single piece of malleable material having generally flat peripheral flanges located at a reference plane defining the periphery of the tray, the tray having first and second side walls, first and second end walls and a bottom, the bottom integrally joining the end walls and side walls, integrally formed tabs defined at the junction of the side walls and the bottom, the tabs extending generally in the plane of the side walls a predetermined distance and the tabs forming a flat display means permitting the package to be displayed in a flat position; and a thin flexible film covering the tray in the reference plane and attached to the peripheral flanges to air tightly seal at least one compartment.

10. A package with at least one compartment for a food product having a bottom, side walls, end walls and a front panel, the package comprising: a tray formed from a single piece of malleable material having generally flat peripheral flanges located in a reference plane defining the periphery of the tray, the tray having first and second side walls, first and second end walls and a bottom, the bottom integrally joining the end walls and side walls; integrally formed tabs defined at the junction of the side walls and the bottom, the tabs extending generally in the plane of the side walls a predetermined distance and some of the tabs with a peripheral flange forming a display means permitting the package to be displayed upright with the front panel located in a vertical plane and flat with a front panel located in a horizontal plane; and a thin flexible film covering the tray in the reference plane and attached to the peripheral flanges to air tightly seal at least one compartment.

* * * * *